US011208997B2

(12) United States Patent
Chady et al.

(10) Patent No.: US 11,208,997 B2
(45) Date of Patent: Dec. 28, 2021

(54) WEAR PLATE FOR A DRILL PUMP

(71) Applicant: GARDNER DENVER PETROLEUM PUMPS LLC, Tulsa, OK (US)

(72) Inventors: Kyle Christopher Chady, Broken Arrow, OK (US); Jordan Anthony Genenbacher, Quincy, IL (US)

(73) Assignee: GARDNER DENVER PETROLEUM PUMPS, LLC, Tulsa, OK (US)

( * ) Notice: Subject to any disclaimer, the term of this patent is extended or adjusted under 35 U.S.C. 154(b) by 565 days.

(21) Appl. No.: 15/919,584

(22) Filed: Mar. 13, 2018

(65) Prior Publication Data

US 2018/0266414 A1 Sep. 20, 2018

Related U.S. Application Data

(60) Provisional application No. 62/471,153, filed on Mar. 14, 2017.

(51) Int. Cl.

| | |
|---|---|
| ***F04B 53/16*** | (2006.01) |
| ***F04B 19/22*** | (2006.01) |
| *E21B 21/00* | (2006.01) |

(52) U.S. Cl.

CPC ..... *F04B 53/16* (2013.01); *F04B 19/22* (2013.01); *E21B 21/00* (2013.01)

(58) Field of Classification Search

CPC ..... F04B 1/053; F04B 19/22; F04B 53/16; E21B 21/00

See application file for complete search history.

(56) References Cited

U.S. PATENT DOCUMENTS

| | | | | |
|---|---|---|---|---|
| 6,209,445 | B1 | 4/2001 | Roberts, Jr. et al. | |
| 6,623,259 | B1 * | 9/2003 | Blume | F04B 53/007 137/543.23 |
| 2018/0202434 | A1 * | 7/2018 | Barnhouse, Jr. | F04B 19/22 |

OTHER PUBLICATIONS

Canadian Patent Office Action for Application No. 2,998,083 dated Jul. 19, 2019 (3 pages).

* cited by examiner

*Primary Examiner* — Abiy Teka
(74) *Attorney, Agent, or Firm* — Edell, Shapiro & Finnan, LLC

(57) ABSTRACT

A wear plate assembly of a drill pump includes a wear plate extending between a first axial end and a second axial end. The wear plate includes an annular cross-section defined by a bore surface and a radial seal surface, an annular seal groove in the radial seal surface at a position between the first axial end and the second axial end, and a shoulder extending radially outward from the radial seal surface at the second axial end.

9 Claims, 7 Drawing Sheets

WEAR PLATE FOR A DRILL PUMP

BACKGROUND

Drilling pumps are used to provide high pressure fluid for drilling operations. The pumps typically include reciprocating plungers or pistons that provide the necessary high pressure fluid.

SUMMARY

The present invention provides a drilling module that includes a wear plate assembly having a dual seal arrangement. A primary seal provides a radial seal while a secondary seal provides an axial seal. The primary seal and the secondary seal can be used together or individually as desired.

In one construction, a user uses the primary seal alone. If the primary seal fails, the user installs the secondary seal.

In one embodiment, the invention provides a wear plate assembly of a drill pump includes a wear plate extending between a first axial end and a second axial end. The wear plate includes an annular cross-section defined by a bore surface and a radial seal surface, an annular seal groove in the radial seal surface at a position between the first axial end and the second axial end, and a shoulder extending radially outward from the radial seal surface at the second axial end.

In another embodiment, the invention provides a method of replacing a radial seal in a wear plate assembly of a drill pump. The wear plate assembly is removed from a fluid end bore of the drill pump. An axial seal is placed around a radial seal surface of a wear plate of the wear plate assembly. The axial seal is abutted against a shoulder of the wear plate, the shoulder extending radially outward from the radial seal surface. The wear plate assembly is inserted into the fluid end bore of the drill pump. The axial seal is axially compressed between the shoulder and a surface of the drill pump.

In yet another embodiment, the invention provides a drilling module of a drill pump. The drilling module includes a housing defining a fluid path having a fluid inlet, a fluid outlet, and a fluid end bore branched off therebetween. The drilling module further includes a piston retainer mounted to the housing at the fluid end bore and a wear plate assembly positioned within the fluid end bore and abutting against the fluid end bore and the piston retainer. The wear plate assembly includes an annular wear plate having a radial outer surface. A radial seal is compressed between the fluid end bore and the radial outer surface of the annular wear plate.

BRIEF DESCRIPTION OF THE DRAWINGS

To easily identify the discussion of any particular element or act, the most significant digit or digits in a reference number refer to the figure number in which that element is first introduced.

DETAILED DESCRIPTION

Figure 1:
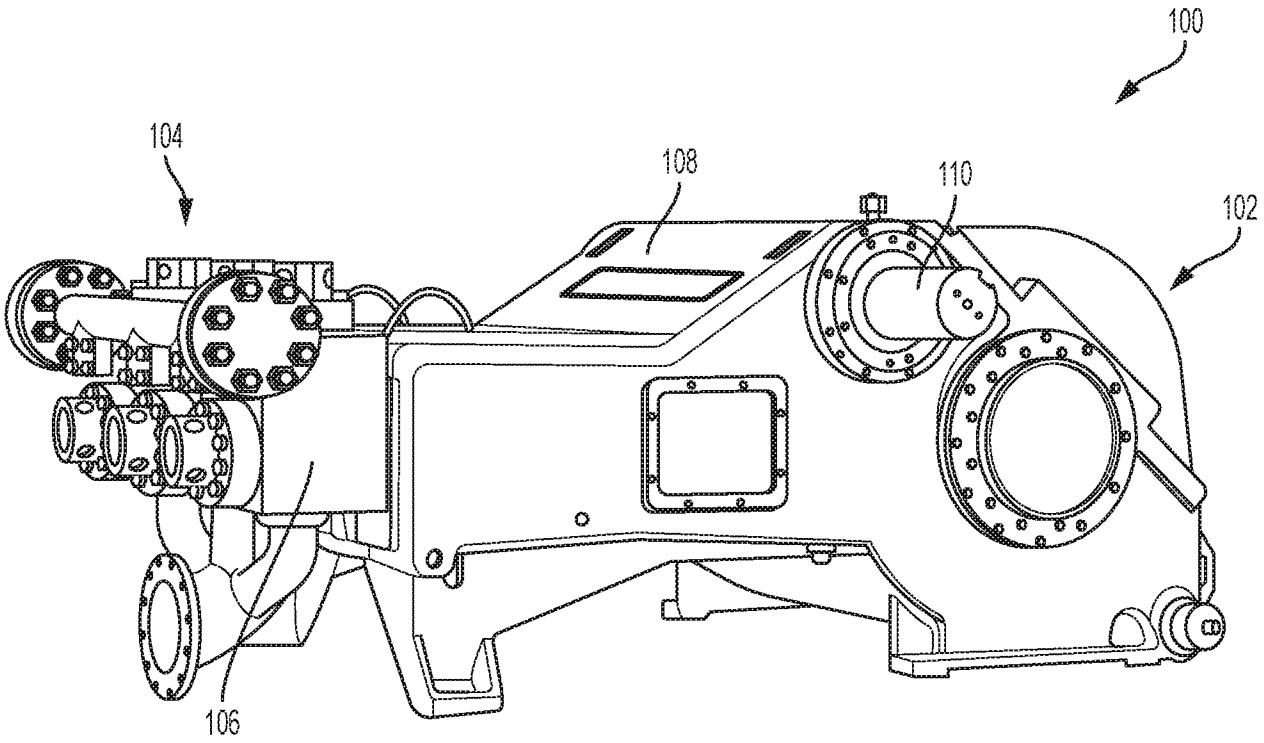
FIG. 1 is a perspective view of a drill pump including a fluid end.

FIG. 1 illustrates a drill pump 100 of the type often used during drilling operations such as hydrocarbon or oil drilling. The drill pump 100 includes a drive end 102 that is largely enclosed within a casing 108. A fluid end 104 attaches to the drive end 102 and the casing 108 and includes at least one drilling module 106, and in the illustrated arrangement three drilling modules 106. A drive shaft 110 extends out of the casing 108 and provides for a connection point for a prime mover such as a motor or engine. The prime mover drives the drive shaft 110 at a desired speed to power the drive end 102. The drive end 102 typically includes a transmission (e.g., gears, belts, chains, etc.) that serve to step down the speed of the drive shaft 110 to a speed appropriate for the fluid end 104. The drive end 102 includes a series of reciprocating mechanisms (one per drilling module 106) that in turn drives a piston or plunger (e.g., piston 702 shown in FIG. 7) within the respective drilling module 106 to pump a fluid.

Figure 2:
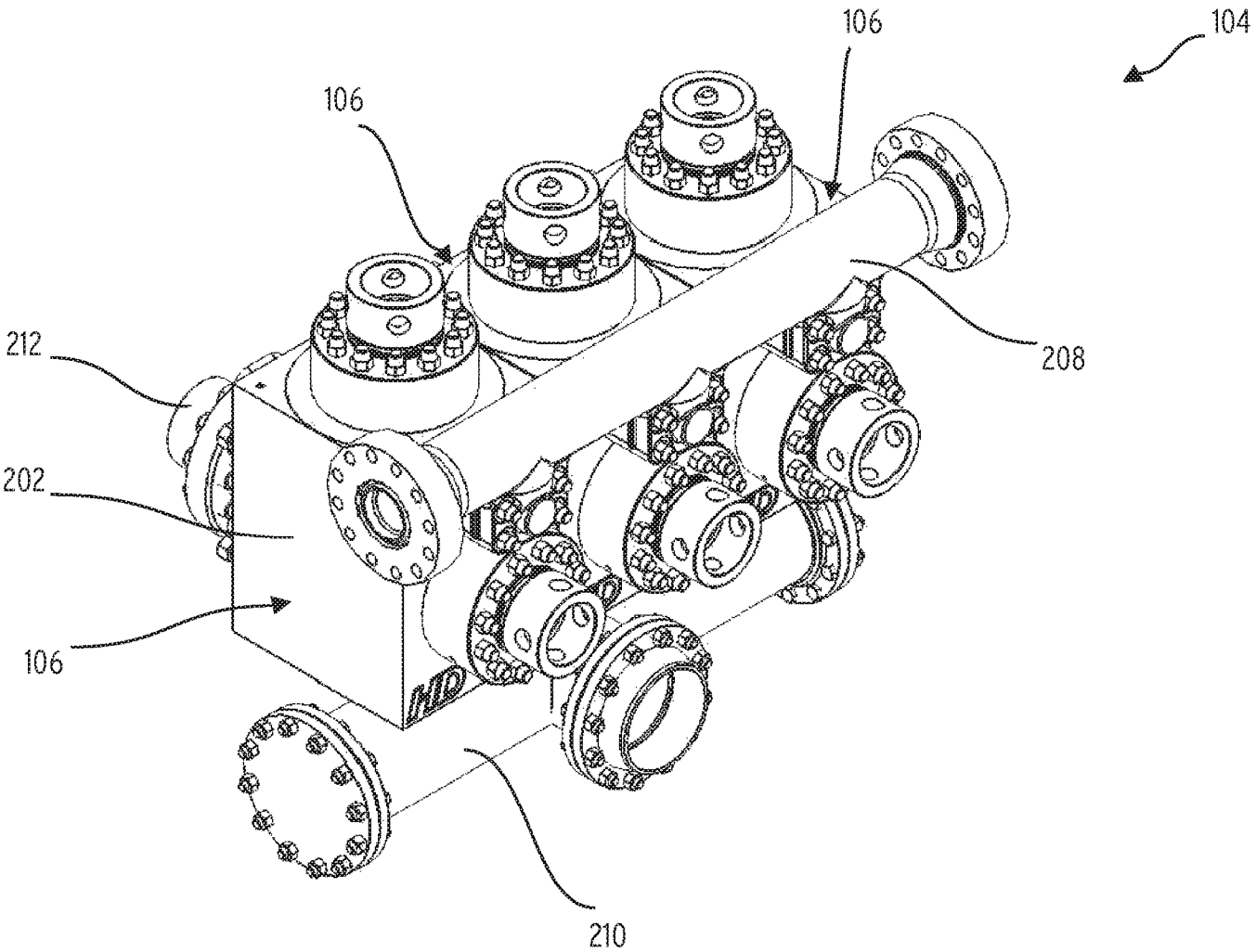
FIG. 2 is a perspective view of the fluid end of FIG. 1.
Figure 7:
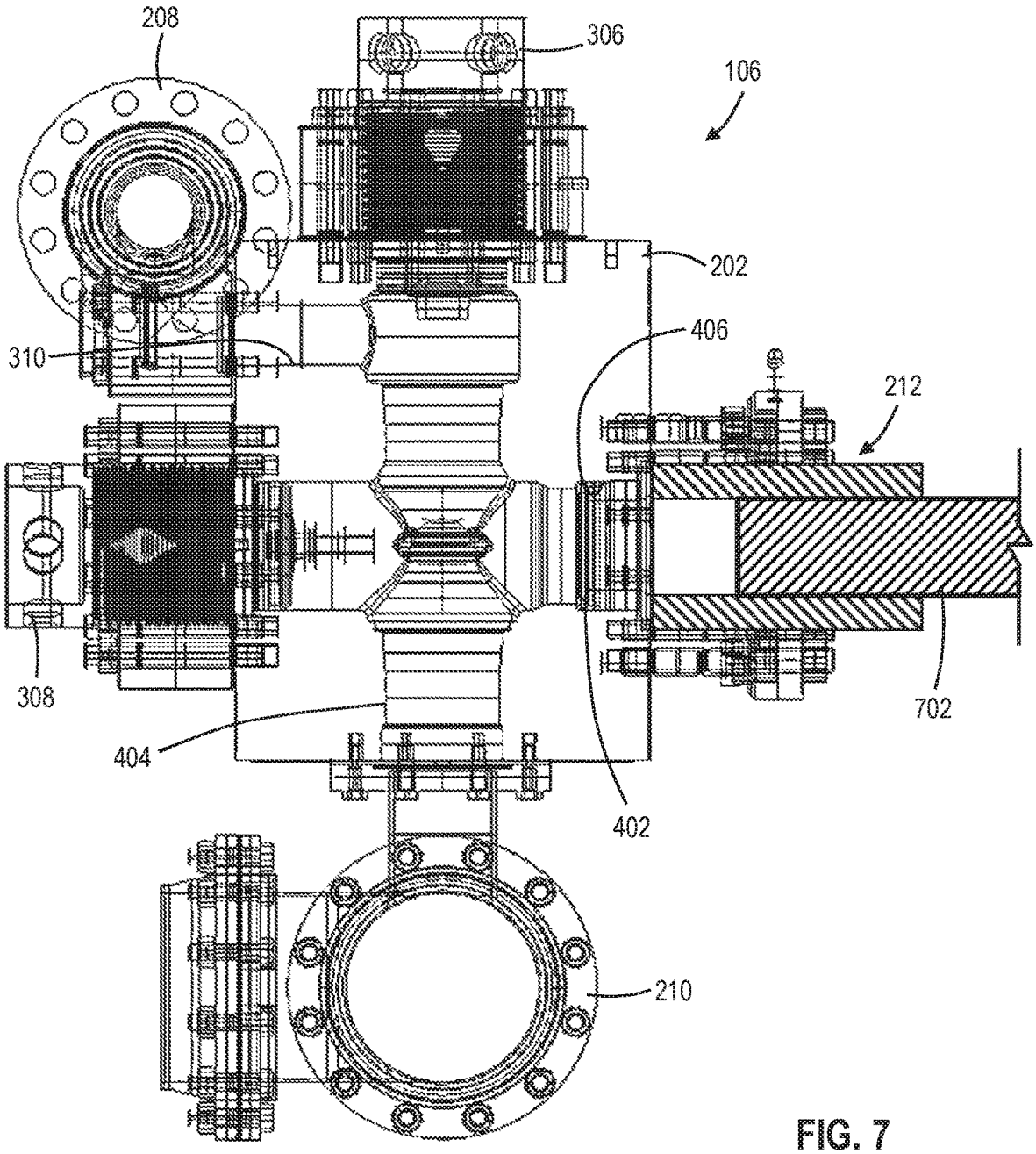
FIG. 7 is a partial perspective view of a drilling module of FIG. 2 and a reciprocating piston.

The fluid end 104 is better illustrated in FIG. 2 and includes three drilling modules 106 positioned adjacent one another. An inlet manifold 210 distributes fluid to an inlet bore 404 (FIG. 4) of each drilling module 106 and an outlet manifold 208 receives pressurized fluid from an outlet bore 310 (FIG. 3) of each drilling module 106. Each drilling module 106 also includes a housing 202 that defines a piston retainer 212 that receives the reciprocating piston 702 (FIG. 7).

Figure 3:
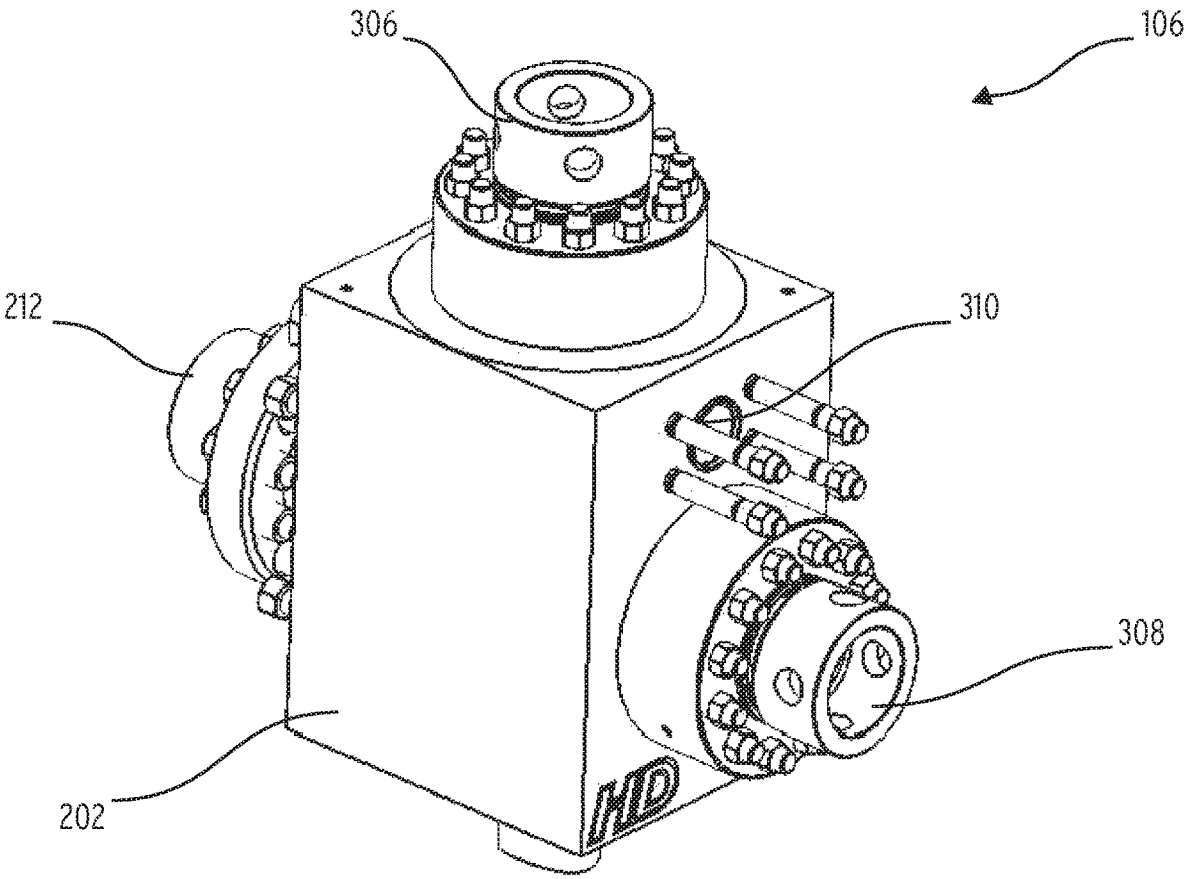
FIG. 3 is a perspective view of a drilling module of FIG. 2.

FIG. 3 better illustrates one drilling module 106 which includes an outlet valve retainer cover 306, a piston bore cover 308, and an outlet bore 310. As discussed with regard to FIG. 2, the drilling module 106 includes a housing 202 that supports a piston retainer 212 which operates to retain the seals and other components needed to support the piston 702 for reciprocation within the drilling module 106.

The outlet valve retainer cover 306 provides support for an outlet valve retainer as well as for any seal mechanisms that might be required. As one of ordinary skill will understand, an outlet valve typically includes a valve member that is biased into a closed position by a biasing member such as a spring. The outlet valve retainer cover 306 supports one end of the biasing member and therefore supports a significant amount of force.

The piston bore cover 308 seals a bore opposite the piston retainer 212. The piston bore cover 308 provides the user access to the interior of the drilling module 106 without having to disassemble the fluid end 104 or remove the fluid end 104 from the drive end 102.

The outlet bore 310 discharges fluid to the outlet manifold 208. The outlet manifold 208 attaches to the housing 202 and sealably engages the housing 202 around the outlet bore 310.

Figure 4:
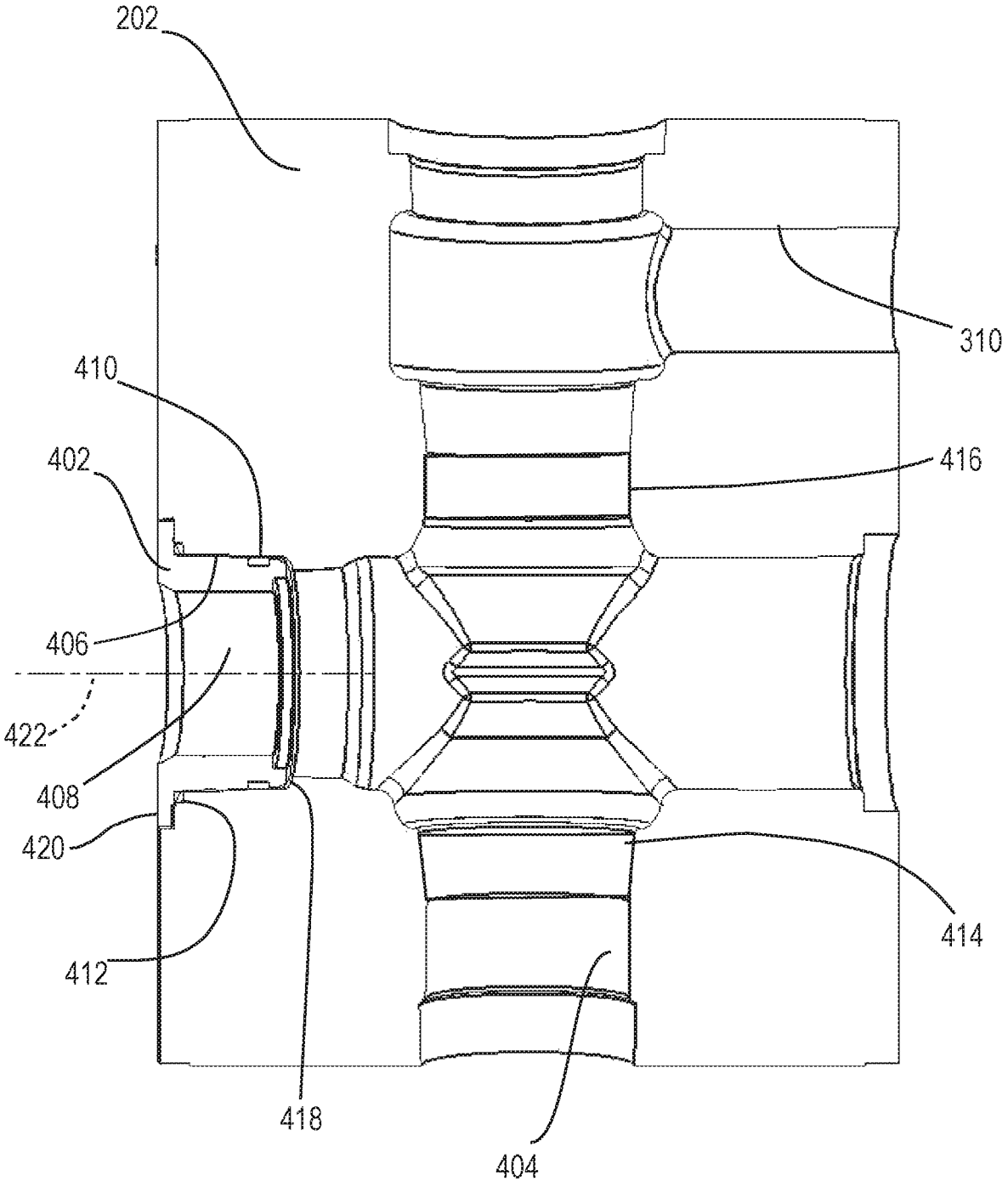
FIG. 4 is a section view of the drilling module of FIG. 3 showing only the housing and a wear plate assembly.

As illustrated in FIG. 4, a wear plate assembly 402 is received within a fluid end bore 406 and includes a bore surface 408 that provides a flow path for fluid between the housing 202 and the piston 702. The wear plate assembly 402 includes a wear plate 502, a primary seal 410, and a secondary seal 412 that are each better illustrated in FIG. 5.

As described above with respect to FIG. 2, the inlet manifold 208 distributes fluid to the inlet bore 404 of each drilling module 106. Within each module 106, a fluid path is defined between the inlet bore 404 and the outlet bore 310.

Within the fluid path, the fluid is pressurized by the reciprocating piston 702, operating in conjunction with first and second valves 414, 416 (shown schematically) positioned within the fluid path. The first valve 414 is positioned between the inlet bore 414 and the fluid end bore 406, which supports the wear plate assembly 402 and controls flow therebetween. The second valve 416 is positioned between the fluid end bore 406 and the outlet bore 310 and controls flow therebetween.

Figure 5:
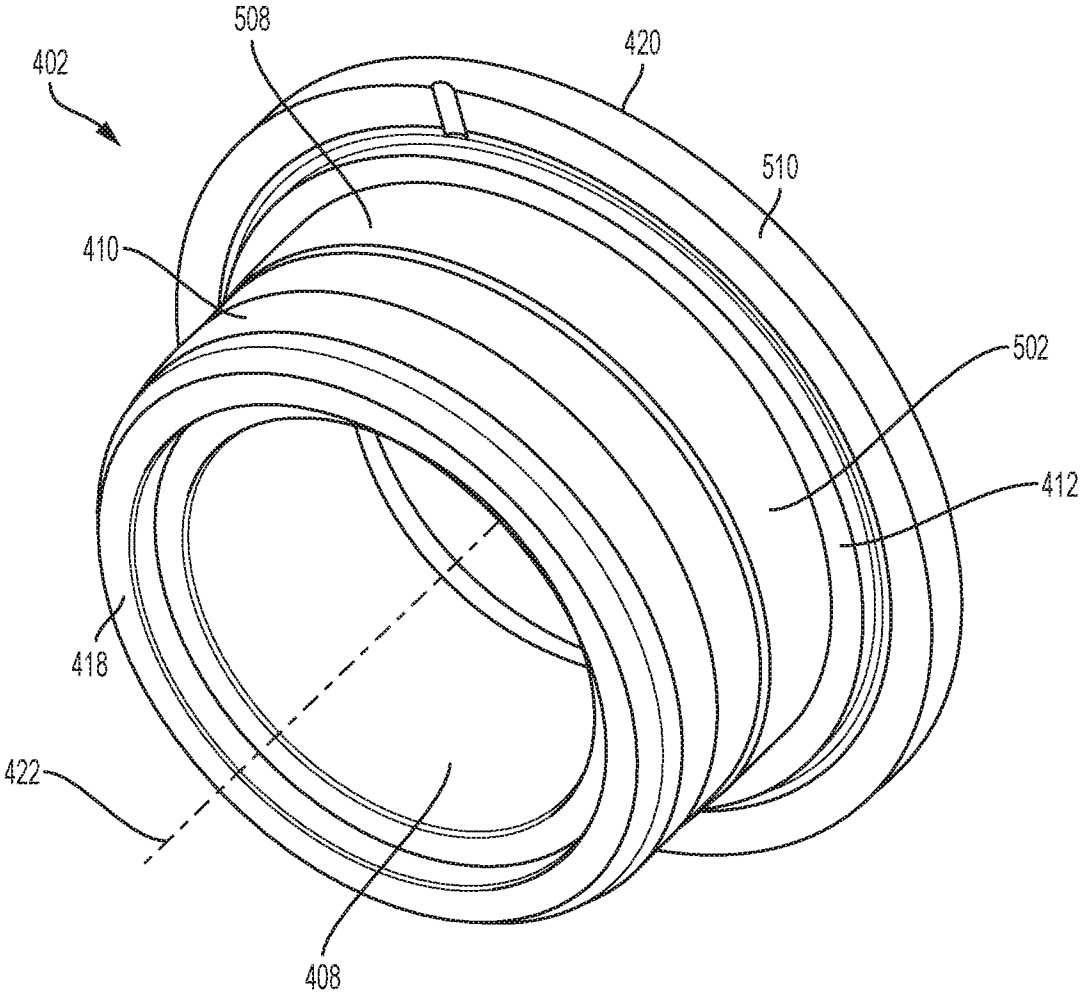
FIG. 5 is a perspective view of the wear plate assembly of FIG. 4.

FIG. 5 illustrates the wear plate assembly 402 in greater detail. The wear plate assembly 402 includes the wear plate 502, the primary seal 410, and the secondary seal 412. The primary seal 410 and the secondary seal 412 can be used together or can be used individually and alone as may be desired and as will be discussed below.

The wear plate 502 is substantially cylindrical with an annular cross section and extends between a first axial end 418 and a second axial end 420. The wear plate 502 includes the bore surface 408 that defines a longitudinal central axis 422 that is substantially aligned with and preferably coaxial with the reciprocating axis of the plunger or piston 702. With respect to discussion of the components of the wear plate assembly 402, unless otherwise stated, a radial direction is defined as a direction transverse to the longitudinal central axis 422. A radial seal surface 508 is sized to engage or fit within the fluid end bore 406 of the housing 202. A shoulder 510 extends radially outward from the second end 420 of the wear plate 502 and provides for an axial stop against a surface of the housing 202 that prevents the insertion of the wear plate assembly 402 into the fluid end bore 406 beyond a desired position.

The primary seal 410 is positioned adjacent the radial seal surface 508 and is arranged to engage the fluid end bore 406 to form a fluid tight radial seal. In preferred constructions, the primary seal 410 is formed from a resilient material such as rubber or a soft metal such as brass or bronze.

The secondary seal 412 is disposed adjacent the shoulder 510 and is arranged to engage a planar surface of the housing 202 to form an axial seal. In preferred constructions, the secondary seal 412 is formed from a resilient material such as rubber or a soft metal such as brass or bronze with other materials also being suitable.

Figure 6:
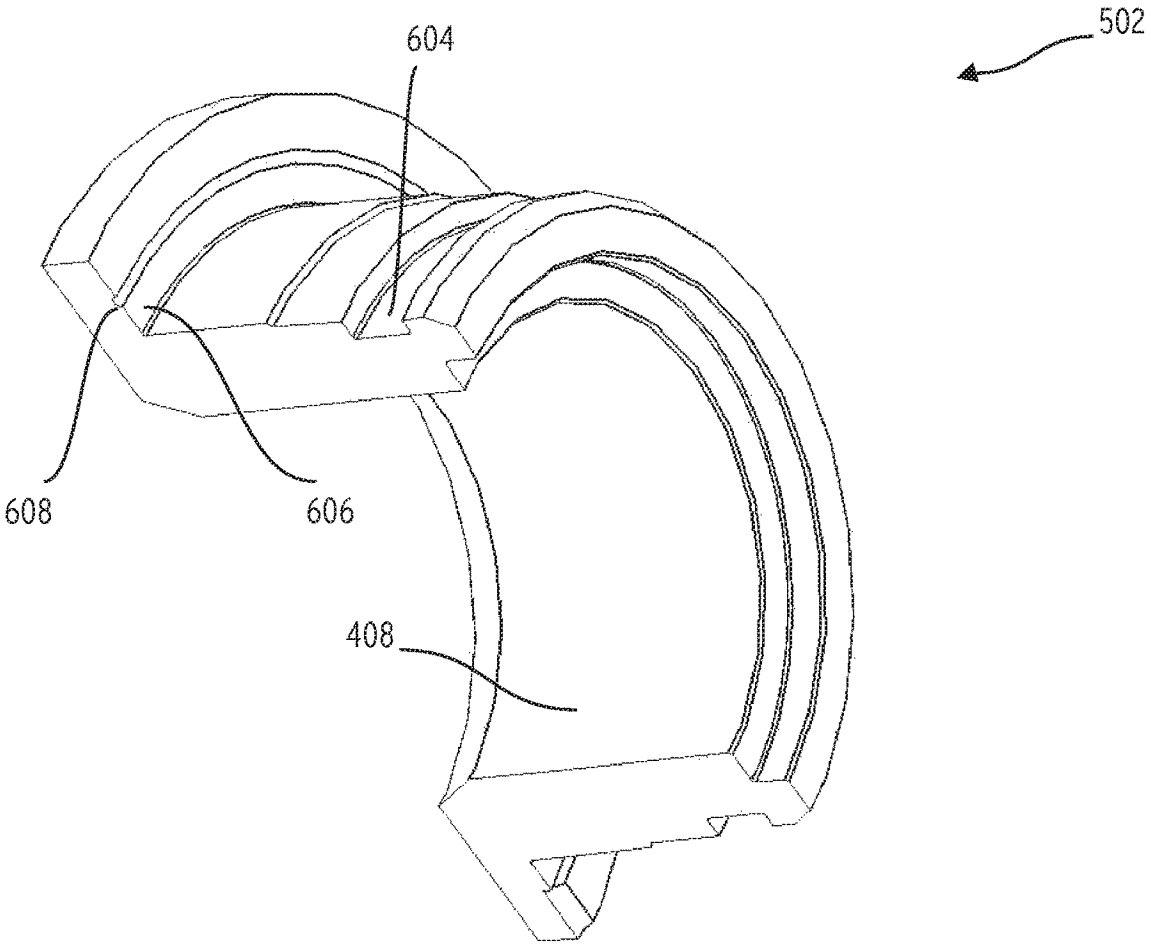
FIG. 6 is a perspective section view of the wear plate of FIG. 5.

FIG. 6 is a section view of the wear plate 502 that better illustrates the arrangement. Specifically, the wear plate 502 includes a primary seal groove 604, a secondary seal space 606, and a relief groove 608. The primary seal groove 604 is a rectangular cross sectioned groove that is sized and arranged to receive and hold the primary seal 410. The primary seal groove 604 holds the primary seal 410 in place during the installation of the wear plate assembly 402 into the housing 202.

The secondary seal space 606 is a planar portion that extends around the shoulder 510 and is sized to receive the secondary seal 412 to form an axial seal. The relief groove 608 is formed adjacent the secondary seal space 606 and extends around the shoulder 510 to provide a compressive relief adjacent the contact area between the secondary seal 412 and the secondary seal space 606. The relief groove 608 is a stress reduction feature of the wear plate 502, and may further provide compressive relief for the secondary seal 412 if the seal is compressed into the relief groove 608.

In operation, the wear plate 502 is inserted into the housing 202 to provide a flow path between the piston 702 and the housing 202. In some constructions, only one of the primary seal 410 and the secondary seal 412 are employed at any given time. The primary seal 410 is typically the preferred seal and the primary seal 410 is installed in the primary seal groove 604 before the wear plate assembly 402 is installed. The primary seal 410 engages the fluid end bore 406 to provide a radial seal.

As is well known, pumps of this type operate in a cyclic environment in which a very high pressure (e.g., 7500 psi) is achieved. It is possible for the primary seal 410 to fail, in which case liquid at very high pressure will be forced past the primary seal 410 at a potential fluid leak path (i.e., the interface between the fluid end bore 406 and the radial outer surface 508 of the wear plate 502). Typically, a failure occurs in a small area of the primary seal 410, thereby producing a high velocity jet of liquid moving between the primary seal 410 and the housing 202. This high velocity jet can further damage the primary seal 410 and can erode the body of the housing 202 in the fluid end bore 406. If the housing 202 is eroded significantly, it can become impossible to repair with a simple replacement of the primary seal 410. In prior designs, this would require a forced disassembly of the fluid end to repair the housing 202 or to replace the drilling module 106.

With the present design, the wear plate assembly 402 can be removed and the secondary seal 412 can be installed. The primary seal 410 can also be replaced or could simply be removed. With the secondary seal 412 in place, the wear plate assembly 402 can be reinstalled and pumping can quickly resume. Therefore, the two seal design provides the user the flexibility needed to avoid forced pumping outages.

What is claimed is:

1. A drilling module of a drill pump, the drilling module comprising:

a housing defining a fluid path having a fluid inlet, a fluid outlet, and a fluid end bore branched off therebetween;

a piston retainer mounted to the housing such that the piston retainer is external to the fluid end bore; and a wear plate assembly positioned within the fluid end bore and abutting against the fluid end bore and the piston retainer, the wear plate assembly comprising:

an annular wear plate having a radial outer surface; and a radial seal compressed between the fluid end bore and the radial outer surface of the annular wear plate.

2. The drilling module of claim 1, wherein an interface between the fluid end bore and the radial outer surface defines a potential fluid leak path, wherein the radial seal obstructs the potential leak path.

3. The drilling module of claim 1, further comprising a first valve and a second valve, wherein both of the first valve and the second valve is positioned in the fluid path between the fluid inlet and the fluid outlet, wherein the first valve is positioned in the fluid path between the fluid inlet and the wear plate assembly, and wherein the second valve is positioned in the fluid path between the wear plate assembly and the fluid outlet.

4. The drilling module of claim 3, wherein a fluid at the wear plate assembly is configured to be pressurized.

5. The drilling module of claim 1, wherein the annular wear plate includes an annular groove, wherein the radial seal is positioned within the annular groove.

6. The drilling module of claim 5, wherein the annular groove includes a rectangular cross-section.

7. The drilling module of claim 1, wherein the annular wear plate includes a shoulder, wherein the wear plate assembly further includes an axial seal compressed between the shoulder of the annular wear plate and the housing.

8. The drilling module of claim 7, wherein the annular wear plate includes a first axial end and a second axial end opposite the first end, wherein the shoulder is located at the second end of the annular wear plate and the radial seal is positioned between the first axial end and the second axial end.

9. The drilling module of claim 7, wherein the radial seal is spaced apart from the axial seal.

* * * * *